US012221682B2

(12) United States Patent
Kim et al.

(10) Patent No.: US 12,221,682 B2
(45) Date of Patent: Feb. 11, 2025

(54) ULTRAHIGH-STRENGTH STEEL HAVING EXCELLENT COLD WORKABILITY AND SSC RESISTANCE, AND MANUFACTURING METHOD THEREFOR

(71) Applicant: POSCO, Pohang-si (KR)

(72) Inventors: Dae-Woo Kim, Pohang-si (KR); Young-Jin Jung, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 810 days.

(21) Appl. No.: 17/294,572

(22) PCT Filed: Nov. 29, 2019

(86) PCT No.: PCT/KR2019/016706
§ 371 (c)(1),
(2) Date: May 17, 2021

(87) PCT Pub. No.: WO2020/111863
PCT Pub. Date: Jun. 4, 2020

(65) Prior Publication Data

US 2022/0002851 A1 Jan. 6, 2022

(30) Foreign Application Priority Data

Nov. 30, 2018 (KR) ..... 10-2018-0153164

(51) Int. Cl.

| | |
|---|---|
| ***C22C 38/04*** | (2006.01) |
| ***C21D 1/19*** | (2006.01) |
| ***C21D 1/26*** | (2006.01) |
| ***C21D 6/00*** | (2006.01) |
| ***C21D 8/02*** | (2006.01) |
| ***C21D 9/46*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/58*** | (2006.01) |

(52) U.S. Cl.
CPC ..... *C22C 38/58* (2013.01); *C21D 1/19* (2013.01); *C21D 1/26* (2013.01); *C21D 6/004* (2013.01); *C21D 6/005* (2013.01); *C21D 6/008* (2013.01); *C21D 8/0226* (2013.01); *C21D 8/0263* (2013.01); *C21D 9/46* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C21D 2211/001* (2013.01); *C21D 2211/002* (2013.01); *C21D 2211/005* (2013.01); *C21D 2211/008* (2013.01)

(58) Field of Classification Search
CPC ..... C21D 2211/005
See application file for complete search history.

(56) References Cited

U.S. PATENT DOCUMENTS

| | | | |
|---|---|---|---|
| 2011/0284137 | A1 | 11/2011 | Kami et al. |
| 2011/0315279 | A1 | 12/2011 | Kaneko et al. |
| 2015/0344998 | A1 | 12/2015 | Kami et al. |
| 2016/0017466 | A1 | 1/2016 | Shibata et al. |
| 2016/0230258 | A1 | 8/2016 | De |
| 2017/0044639 | A1 | 2/2017 | Kitsuya et al. |
| 2019/0024206 | A1 | 1/2019 | Kim |
| 2019/0112682 | A1 | 4/2019 | Kohsaka et al. |

FOREIGN PATENT DOCUMENTS

| | | | |
|---|---|---|---|
| CN | 102348821 | A | 2/2012 |
| CN | 102828125 | A | 12/2012 |
| CN | 104619877 | A | 5/2015 |

(Continued)

OTHER PUBLICATIONS

English machine translation of JP 2005-256044 A of Kawabe (Year: 2005).*

(Continued)

*Primary Examiner* — Jophy S. Koshy

(74) *Attorney, Agent, or Firm* — Morgan, Lewis & Bockius LLP

(57) ABSTRACT

One embodiment of the present invention provides an ultra-high-strength steel having excellent cold workability and SSC resistance, comprising, by wt %, carbon (C) in an amount of more than 0.08% and equal to or less than 0.2%, 0.05-0.5% of silicon (Si), 0.5-2% of manganese (Mn), 0.005-0.1% of aluminum (Al), 0.01% or less of phosphorus (P), 0.0015% or less of sulfur (S), 0.001-0.03% of niobium (Nb), 0.001-0.03% of vanadium (V), 0.001-0.03% of titanium (Ti), 0.01-1% of chromium (Cr), 0.01-0.15% of molybdenum (Mo), 0.01-0.5% of copper (Cu), 0.05-4% of nickel (Ni), 0.0005-0.004% of calcium (Ca), and the balance of Fe and other inevitable impurities, wherein the microstructure of a surface layer part, which is the region from the surface to 10% of the total thickness, comprises 90 area % or more of polygonal ferrite, the microstructure of the region excluding the surface layer part comprises 90 area % or more of tempered martensite or 90 area % or more of a mixed structure of tempered martensite and tempered bainite, and the dislocation density of the surface layer part is 3×10 14/m 2 or less.

5 Claims, No Drawings

(56) References Cited

FOREIGN PATENT DOCUMENTS

| | | | |
|---|---|---|---|
| CN | 108368595 | A | 8/2018 |
| EP | 2740812 | A1 | 6/2014 |
| EP | 3026140 | A1 | 6/2016 |
| EP | 3147379 | A1 | 3/2017 |
| JP | 2005-256044 | A | 9/2005 |
| JP | 2012-241273 | A | 12/2012 |
| JP | 5679091 | B1 | 3/2015 |
| JP | 2016-108648 | A | 6/2016 |
| JP | 2017-002384 | A | 1/2017 |
| JP | 2018-168441 | A | 11/2018 |
| JP | 2018-188696 | A | 11/2018 |
| JP | 2019-504210 | A | 2/2019 |
| KR | 10-1333854 | B1 | 11/2013 |
| KR | 10-2015-0138301 | A | 12/2015 |
| KR | 10-2016-0143732 | A | 12/2016 |
| WO | 2015/178320 | A1 | 11/2015 |
| WO | 2017/169870 | A1 | 10/2017 |

OTHER PUBLICATIONS

Extended European Search Report dated Dec. 7, 2021 issued in European Patent Application No. 19888857.0.
Japanese Office Action dated Jun. 28, 2022 issued in Japanese Patent Application No. 2021-530175.
International Search Report dated Mar. 5, 2020 issued in International Patent Application No. PCT/KR2019/016706 (with English translation).
Chinese Office Action dated Jan. 30, 2022 issued in Chinese Patent Application No. 201980078203.3 (with English translation).

* cited by examiner

ULTRAHIGH-STRENGTH STEEL HAVING EXCELLENT COLD WORKABILITY AND SSC RESISTANCE, AND MANUFACTURING METHOD THEREFOR

CROSS-REFERENCE OF RELATED APPLICATIONS

This application is the U.S. National Phase under 35 U.S.C. § 371 of International Patent Application No. PCT/KR2019/016706, filed on Nov. 29, 2019, which in turn claims the benefit of Korean Application No. 10-2018-0153164, filed on Nov. 30, 2018, the entire disclosures of which applications are incorporated by reference herein.

TECHNICAL FIELD

The present disclosure relates to an ultrahigh-strength steel having excellent cold workability and SSC resistance and a manufacturing method therefor, and more particularly, to an ultrahigh-strength steel having excellent cold workability and SSC resistance that is applicable to offshore structures or the like, such as a petroleum drilling vessel or a wind power installation vessel, and a manufacturing method therefor.

BACKGROUND ART

Recently, facilities have become lightweight and environments requiring resistance to sourness or corrosion have increasingly been used, and accordingly, it has been demanded that steels for offshore structures used in petroleum drilling facilities and the like have ultra-high strength and resistance to hydrogen-induced cracking. In particular, there have been increasing requirements for resistance to sulfide stress cracking (SSC) related to resistance to hydrogen generated in a corrosive environment under stress.

Since an ultrahigh-strength steel having a yield strength of 690 MPa or more, having been developed for the aforementioned purpose, has very high strength in a plate state, it is usually manufactured as a steel pipe by hot-forming a thick plate in an as-rolled state into a pipe and then subjecting the pipe to QT heat treatment. Such a hot forming method is advantageous in that forming can be performed even with a small amount of force, and even an extremely thick product having a thickness of more than 100 mm can be manufactured to form a steel pipe, but is disadvantageous in that a separate process is required to remove scale generated in the steel pipe after heat treatment, and it is difficult to secure precision in dimension due to deformation at the time of quenching. Thus, for a QT heat-treated material, cold forming has recently been used widely, although the cold forming has a higher risk of causing a crack at the time of bending than the hot forming.

Meanwhile, in order to secure a yield strength of 690 MPa or more as in Patent Document 1, it is required to secure tempered martensite or a mixed structure of tempered martensite and tempered bainite mixture structure after QT heat treatment by controlling a steel at an appropriate cooling rate.

However, a low-temperature transformation structure such as martensite or bainite has a significantly smaller uniform elongation value than a soft structure, thereby causing a surface crack at the time of cold working. In addition, when corrosion occurs on a surface layer portion due to high dislocation density thereof, hydrogen may easily migrate into the steel, and resistance to crack propagation may be weak, resulting in a decrease in SSC resistance.

Therefore, the above-described conventional methods have limitations in manufacturing an ultrahigh-strength steel having excellent cold workability and SSC resistance, the steel having a thickness of 6 to 100 mm and a yield strength of 690 MPa or more, for use in an offshore structure.

RELATED ART DOCUMENT (Patent Document 1) Korean Patent Laid-Open Publication No. 2016-0143732

DISCLOSURE

Technical Problem

An aspect of the present disclosure may provide an ultrahigh-strength steel having excellent cold workability and SSC resistance and a manufacturing method therefor.

Technical Solution

According to an aspect of the present disclosure, an ultrahigh-strength steel having excellent cold workability and SSC resistance may contain, by wt %, more than 0.08% and 0.2% or less of carbon (C), 0.05 to 0.5% of silicon (Si), 0.5 to 2% of manganese (Mn), 0.005 to 0.1% of aluminum (Al), 0.01% or less of phosphorus (P), 0.0015% or less of sulfur (S), 0.001 to 0.03% of niobium (Nb), 0.001 to 0.03% of vanadium (V), 0.001 to 0.03% of titanium (Ti), 0.01 to 1% of chromium (Cr), 0.01 to 0.15% of molybdenum (Mo), 0.01 to 0.5% of copper (Cu), 0.05 to 4% of nickel (Ni), and 0.0005 to 0.004% of calcium (Ca), with a balance of Fe and other inevitable impurities, wherein a microstructure of a surface layer portion, which is a region from a surface of the steel to 10% of a total thickness of the steel, contains 90 area % or more of polygonal ferrite, a microstructure of a region excluding the surface layer portion contains 90 area % or more of tempered martensite or 90 area % or more of a mixed structure of tempered martensite and tempered bainite, and the surface layer portion has a dislocation density of $3\times10^{14}/m^2$ or less.

According to another aspect of the present disclosure, a method for manufacturing an ultrahigh-strength steel having excellent cold workability and SSC resistance may include: heating a steel slab at a temperature of 1000 to 1200° C., the steel slab containing, by wt %, more than 0.08% and 0.2% or less of carbon (C), 0.05 to 0.5% of silicon (Si), 0.5 to 2% of manganese (Mn), 0.005 to 0.1% of aluminum (Al), 0.01% or less of phosphorus (P), 0.0015% or less of sulfur (S), 0.001 to 0.03% of niobium (Nb), 0.001 to 0.03% of vanadium (V), 0.001 to 0.03% of titanium (Ti), 0.01 to 1% of chromium (Cr), 0.01 to 0.15% of molybdenum (Mo), 0.01 to 0.5% of copper (Cu), 0.05 to 4% of nickel (Ni), and 0.0005 to 0.004% of calcium (Ca), with a balance of Fe and other inevitable impurities; hot-rolling the heated slab at a temperature of 800 to 950° C. with an average reduction ratio of 10% or more per pass to obtain a hot-rolled steel; air-cooling the hot-rolled steel to room temperature, and then reheating the air-cooled hot-rolled steel to a temperature of 800 to 950° C.; primarily cooling the reheated hot-rolled steel to 700° C. at a cooling rate of 0.1° C./s or more and less than 10° C./s based on a steel surface temperature; secondarily cooling the primarily cooled hot-rolled steel to room temperature at a cooling rate of 50° C./s or more, based on the steel surface temperature; and heating and maintaining the secondarily cooled hot-rolled steel at a temperature of 550 to 700° C. for 5 to 60 minutes for tempering heat treatment.

Advantageous Effects

According to an aspect of the present disclosure, an ultrahigh-strength steel having excellent cold workability and SSC resistance and a manufacturing method therefor can be provided.

BEST MODE

The present disclosure is characterized in that a steel has further improved cold workability and SSC resistance by controlling an alloy composition of the steel and microstructures of a surface layer portion and a region other than the surface layer portion (hereinafter also referred to as the 'center portion') of the steel.

Hereinafter, an ultrahigh-strength steel having excellent cold workability and SSC resistance according to an exemplary embodiment of the present disclosure will be described in detail. First, the alloy composition of the present disclosure will be described. The unit of the alloy composition to be described below is wt % unless otherwise specified.

Carbon (C): more than 0.08% and 0.2% or less

C, which is the most important element in securing basic strength, needs to be contained in the steel in an appropriate range. In order to obtain such an effect by adding C, the C content is preferably more than 0.08%. However, if the C content exceeds 0.2%, the strength and hardness of a base material may be excessively high at the time of quenching, particularly causing a sharp decrease in resistance to crack propagation in the center portion of the steel, although the surface layer portion of the steel may have good SSC resistance due to generation of soft ferrite therein. On the other hand, if the C content is 0.08% or less, the steel may not have appropriate hardenability, and thus, it may not be easy to secure a yield strength of 690 MPa or more. Therefore, the C content is preferably in the range of between more than 0.08% and 0.2% or less.

Silicon (Si): 0.05 to 0.5%

Si, which is a substitutional element improving the strength of the steel through solid solution strengthening while having a strong deoxidation effect, is an essential element in manufacturing clean steel. Therefore, Si is preferably added in an amount of 0.05% or more. However, if the Si content exceeds 0.5%, an MA phase may be formed and the strength of a matrix, such as ferrite in the surface layer portion or tempered martensite or tempered bainite in the center portion, may excessively increase, resulting in deteriorations in SSC resistance, impact toughness, and the like. Therefore, the Si content is preferably in the range of 0.05 to 0.5%.

Manganese (Mn): 0.5 to 2%

Mn is a useful element in improving strength through solid solution strengthening and in improving hardenability to form a low-temperature transformation phase. In order to secure a yield strength of 690 MPa or more, Mn is preferably added in an amount of 0.5% or more. However, an upper limit of the Mn content is preferably 2% or less, because as the Mn content increases, Mn may react with S, resulting in formation of MnS, which is an elongated non-metallic inclusion, thereby decreasing toughness and causing the center portion of the steel to serve as a hydrogen embrittlement crack initiation site. Therefore, the Mn content is preferably in the range of 0.5 to 2%.

Aluminum (Al): 0.005 to 0.1%

Together with Si, Al is one of the strong deoxidizers in a steel manufacturing process. In order to obtain such an effect, Al is preferably added in an amount of 0.005% or more. However, if the Al content exceeds 0.1%, a fraction of $Al_2O_3$ in an oxidative inclusion formed as a resultant product of deoxidation may excessively increase, resulting in a problem that the oxidative inclusion may be coarse, and it may be difficult to remove the oxidative inclusion during refining. The oxidative inclusion disadvantageously causes decreases in impact toughness and SSC resistance of the steel. Therefore, the Al content is preferably in the range of 0.005 to 1%.

Phosphorus (P): 0.01% or less

P is an element causing embrittlement along grain boundaries or causing embrittlement by forming coarse inclusions. In order to improve SSC resistance, the P content is preferably controlled to 0.01% or less.

Sulfur (S): 0.0015% or less

S is an element causing embrittlement along grain boundaries or causing embrittlement by forming coarse inclusions. In order to improve SSC resistance, the S content is preferably controlled to 0.0015% or less.

Niobium (Nb): 0.001 to 0.03%

Nb is precipitated in the form of NbC or Nb(C,N) to improve the strength of the base material. Further, Nb solid-dissolved at the time of reheating at a high temperature is precipitated very finely in the form of NbC at the time of rolling, thereby suppressing recrystallization of austenite, resulting in a structure refining effect. For the aforementioned effect, Nb is preferably added in an amount of 0.001% or more. However, if the Nb content exceeds 0.03%, non-dissolved Nb may be formed in the form of Ti,Nb(C,N), resulting in degradation strength and SSC resistance. Therefore, the Nb content is preferably in the range of 0.001 to 0.03%.

Vanadium (V): 0.001 to 0.03%

V is almost solid-dissolved again at the time of reheating, and thus, V does not cause a significant reinforcing effect by precipitation or solid solution at the time of subsequent rolling. However, V is precipitated as very fine carbonitride in a subsequent heat treatment process such as PWHT, resulting in a strength improving effect. In order to sufficiently obtain such an effect, it is required to add V in an amount of 0.001% or more. However, if the V content exceeds 0.03%, a portion to be welded may have excessively high strength and hardness, resulting in a surface crack or the like at the time of processing the steel for use in an offshore structure or the like. Further, manufacturing costs may significantly increase, which is economically disadvantageous. Therefore, the V content is preferably in the range of 0.001 to 0.03%.

Titanium (Ti): 0.001 to 0.03%

Ti is a component precipitated as TiN at the time of reheating to suppress growth of grains in the base material and a portion affected by welding heat, thereby greatly improving low-temperature toughness. In order to obtain such an effect by adding Ti, Ti is preferably added in an amount of 0.001% or more. However, if Ti is added in an amount of more than 0.03%, a continuous casting nozzle may be clogged or the center portion may be crystallized, resulting in a decrease in low-temperature toughness. When Ti is bound to N and accordingly a coarse TiN precipitate is formed in the center portion in a thickness direction, the coarse TiN precipitate may serve as an SSC crack initiation site. Therefore, the Ti content is preferably in the range of 0.001 to 0.03%.

Chromium (Cr): 0.01 to 1%

Chromium (Cr) is effective in increasing hardenability to form a low-temperature transformation structure, thereby increasing yield strength and tensile strength, while decreasing a decomposition rate of cementite during tempering after quenching or during post-welding heat treatment (PWHT), thereby decreasing strength. In order to obtain the aforementioned effect, Cr is preferably added in an amount of 0.01% or more. However, if the Cr content exceeds 1%, a size and a fraction of Cr-rich coarse carbide such as $M_{23}C_6$ may increase, which is not preferable because there are problems that impact toughness may greatly decrease, manufacturing costs may increase, and weldability may deteriorate. Therefore, the Cr content is preferably in the range of 0.01 to 1%.

Molybdenum (Mo): 0.01 to 0.15%

Like Cr, Mo is an element that is effective in preventing a decrease in strength during tempering or post-welding heat treatment (PWHT), which is a post process, and preventing a decrease in toughness caused by segregation of impurities such as P along grain boundaries. In addition, Mo increases hardenability and accordingly increases a fraction of a low-temperature phase such as martensite or bainite, thereby enhancing the strength of a matrix phase. In order to obtain the aforementioned effect, Mo is preferably added in an amount of 0.01% or more. However, if Mo is excessively added, manufacturing costs may greatly increase because Mo is an expensive element, and thus, MO is preferably added in an amount of 0.15% or less. Therefore, the Mo content is preferably in the range of 0.01 to 0.15%.

Copper (Cu): 0.01 to 0.5%

Cu is effective in not only greatly improving the strength of the matrix phase through solid solution strengthening but also suppressing corrosion in a wet hydrogen sulfide atmosphere. Thus, Cu is an advantageous element in the present disclosure. In order to sufficiently obtain the aforementioned effect, Cu needs to be added in an amount of 0.01% or more. However, if the Cu content exceeds 0.50%, there may be problems that it is highly likely to cause a star crack in a surface of a steel sheet, and manufacturing costs greatly increases because Cu is an expensive element. Therefore, the Cu content is preferably in the range of 0.01 to 0.50%.

Nickel (Ni): 0.05 to 4%

Nickel (Ni) is an important element in increasing a stacking fault at a low temperature to facilitate cross slip of dislocation, thereby improving impact toughness and hardenability to increase strength. In order to obtain such an effect, Ni is preferably added in an amount of 0.05% or more. However, if Ni is added in an amount of more than 4%, hardenability may excessively increase, and manufacturing costs may increase because Ni is expensive as compared to other hardenable elements. Therefore, the Ni content is preferably in the range of 0.05 to 4%.

Calcium (Ca): 0.0005 to 0.004%

When Ca is added after being deoxidized by Al, Ca is bound to S, which forms MnS inclusions. Accordingly, Ca is effective in suppressing formation of MnS and simultaneously forming spherical CaS, thereby suppressing an SSC crack. In order to form sufficient CaS from S contained as impurities in the present disclosure, Ca is preferably added in an amount of 0.0005% or more. However, if the Ca content exceeds 0.004%, Ca remaining after forming CaS may be bound to O, thereby forming coarse oxidative inclusions, resulting in a problem that the coarse oxidative inclusion may be stretched and broken at the time of rolling, thereby serving as an SSC crack initiation site. Therefore, the Ca content is preferably in the range of 0.0005 to 0.004%.

According to the present disclosure, the balance is iron (Fe). Meanwhile, unintended impurities may be inevitably mixed from raw materials or surrounding environments in a common manufacturing process, and the impurities cannot be excluded. Such impurities are known to any person skilled in the common manufacturing process, and thus, all descriptions thereof will not be particularly provided in the present specification.

Meanwhile, the steel of the present disclosure preferably has a Ceq of 0.5 or more, the Ceq being expressed by Relational Expression 1 below. The Ceq is for increasing hardenability and accordingly securing a fraction of a low-temperature phase such as martensite or bainite, thereby securing a yield strength of 690 MPa or more as proposed in the present disclosure for ultrahigh strength. If the Ceq is less than 0.5, a sufficient low-temperature transformation structure may not be formed, resulting in a disadvantage that appropriate strength cannot be secured.

$$Ceq=C+Mn/6+(Cu+Ni)/15+(Cr+Mo+V)/5 \quad \text{[Relational Expression 1]}$$

(In Relational Expression 1, C, Mn, Cu, Ni, Cr, Mo, and V are based on wt %.)

Meanwhile, in the steel of the present disclosure, it is preferable that a microstructure of a surface layer portion, which is a region from a surface of the steel to 10% of a total thickness of the steel, contains 90 area % or more of polygonal ferrite, and a microstructure of a region (center portion) excluding the surface layer portion contains 90 area % or more of tempered martensite or 90 area % or more of a mixed structure of tempered martensite and tempered bainite. By controlling the microstructure of the center portion to contain 90 area % or more of the mixed structure of tempered martensite and tempered bainite as described above, excellent yield strength and tensile strength can be secured. However, the mixed structure of tempered martensite and tempered bainite has a significantly lower uniform elongation value than a soft structure, thereby causing a surface crack during cold working. In addition, when corrosion occurs on the surface layer portion due to its high dislocation density, hydrogen may easily migrate into the steel, and resistance to crack propagation may be weak, resulting in a deterioration in SSC resistance. As compared with tempered martensite or tempered bainite, ferrite, having a lower dislocation density while having a lower strength, advantageously has a higher uniform elongation with a relatively lower degree of work hardening at the time of cold working. Since the surface layer portion of the steel is deformed at the highest strain rate at the time of cold working, when the microstructure of the surface layer portion contains 90 area % or more polygonal ferrite, not only cold workability but also SSC resistance can be improved. Meanwhile, the balance of the microstructure of the surface layer portion may be at least one of pearlite, bainite, and martensite, and the balance of the microstructure of the center portion may be at least one of ferrite and pearlite.

In this case, the surface layer portion preferably has a dislocation density of $3\times10^{14}/m^2$ or less. If the dislocation density of the surface layer portion exceeds $3\times10^{14}/m^2$, hydrogen generated from the surface layer portion when corroded may migrate into the steel at a high rate, and the strength of the matrix phase may also increase through work hardening, resulting in a disadvantage that SSC resistance deteriorates.

The steel of the present disclosure preferably has a thickness of 6 to 100 mm. If the thickness of the steel is less than 6 mm, there is a disadvantage that the steel is difficult to manufacture with a thick plate rolling machine. If the thickness of the steel exceeds 100 mm, an appropriate cooling rate is not secured, and accordingly, it is difficult to secure appropriate strength, that is, a yield strength of 690 MPa or more as proposed in the present disclosure.

In the steel of the present disclosure provided as described above, the surface layer portion may have a uniform elongation of 10% or more, a yield strength of 690 MPa or more, and a tensile strength of 780 MPa or more. Meanwhile, when the thickness of the steel is 100 mm, a maximum surface strain rate applied to the surface layer portion at the time of cold working is 7% or less. Thus, if the uniform elongation is 10% or more, a necking phenomenon does not occur even during processing, thereby not causing a surface defect.

Hereinafter, a method for manufacturing the ultrahigh-strength steel having excellent cold workability and SSC resistance according to an exemplary embodiment of the present disclosure will be described in detail.

First, a steel slab having the above-described alloy composition is heated at a temperature of 1000 to 1200° C. The heating of the steel slab is preferably performed at 1000° C. or higher to prevent an excessive decrease in temperature in a subsequent rolling process. However, if the temperature for heating the steel slab exceeds 1200° C., there are disadvantages that a total rolling reduction in a non-recrystallization temperature range is not sufficient, and even if a controlled rolling start temperature is low, the steel slab is excessively left in an air-cooled state, resulting in inferior cost competitiveness in operating a furnace. Therefore, the temperature for heating the steel slab is preferably in the range of 1000 to 1200° C.

Thereafter, the heated slab is hot-rolled at a temperature of 800 to 950° C. with an average reduction ratio of 10% or more per pass to obtain a hot-rolled steel. If the hot-rolling temperature is lower than 800° C., rolling may be performed in an austenite-ferrite two-phase region, resulting in an increase in deformation resistance value during rolling, such that the slab cannot be rolled to a normal target thickness. If the hot-rolling temperature exceeds 950° C., austenite grains become too coarse, and thus it is not possible to expect improvements in strength and SSC resistance according to grain refinement. In addition, if the average reduction ratio per pass is less than 10%, it may be difficult to obtain the microstructure of the surface layer portion intended by the present disclosure. Therefore, the average reduction ratio per pass at the time of hot rolling is preferably controlled to 10% or more. However, the average reduction ratio per pass is preferably 20% or less, taking into account a limited rolling reduction per mill of the rolling machine, a roll life, etc.

Thereafter, the hot-rolled steel is air-cooled to room temperature, and then reheated to a temperature of 800 to 950° C. The reheating is for sufficiently homogenizing the austenite structure and making an average grain size minute. In order to sufficiently obtain the aforementioned effect, the reheating temperature needs to be 800° C. or higher. However, if the reheating temperature exceeds 950° C., the average grain size of the austenite may increase, resulting in decreases in toughness and SSC resistance. Meanwhile, the reheating may be performed for 5 to 60 minutes. If the reheating time is less than 5 minutes, the alloy components and the microstructures may be insufficiently homogenized. If the reheating time exceeds 60 minutes, there is a disadvantage that austenite grains and fine precipitates such as NbC may be coarse, resulting in a deterioration in SSC resistance.

After the reheating, the average grain size of the austenite in the hot-rolled steel is preferably 30 μm or less. By controlling the average grain size of the austenite in the hot-rolled steel after the reheating to 30 μm or less as described above, when an SSC crack occurs, the crack may propagate at slow speed. More preferably, the average grain size of the austenite in the hot-rolled steel after the reheating is 25 μm or less.

Thereafter, the hot-rolled steel is primarily cooled to 700° C. at a cooling rate of 0.1° C./s or more and less than 10° C./s, based on a steel surface temperature. The primary cooling is for forming 90 area % or more of polygonal ferrite in the surface layer portion of the steel. If the cooling rate at the time of primary cooling is less than 0.1° C./s, nucleation of ferrite may not be smooth and the grains may be coarse. The coarse grains may disadvantageously cause not only a deterioration in strength but also a deterioration in resistance to crack propagation when an SSC crack occurs. If the cooling rate at the time of primary cooling is 10° C./s or more, a large amount of bainite may be formed in the surface layer portion, thereby making it difficult to secure excellent cold workability and SSC resistance. Therefore, the cooling rate at the time of primary cooling is preferably in the range of between 0.1° C./s or more and less than 10° C./s. Meanwhile, the primary cooling may be performed by quenching at a high sheet-passing speed of the steel and at a low flow rate of water sprayed on the steel, or may be performed through an air cooling process or the like.

Thereafter, the primarily cooled hot-rolled steel is secondarily cooled to room temperature at a cooling rate of 50° C./s or more, based on the steel surface temperature. The secondary cooling is for strong cooling through which the microstructure of the region other than the surface layer portion, that is, the microstructure of the center portion in the steel, contains 90 area % or more of martensite or a mixed structure of martensite and bainite. If the cooling rate at the time of secondary cooling is less than 50° C./s, it may be difficult to obtain the low-temperature transformation structure and the fraction thereof described above. In the present disclosure, an upper limit of the cooling rate at the time of secondary cooling is not particularly limited, but the cooling rate at the time of secondary cooling may be controlled to 200° C./s or less. Meanwhile, the secondary cooling may be performed by quenching at a low sheet-passing speed of the steel and at a high flow rate of water sprayed on the steel.

Thereafter, the secondarily cooled hot-rolled steel is heated and maintained at a temperature of 550 to 700° C. for 5 to 60 minutes for tempering heat treatment. Through the tempering heat treatment, the dislocation density of martensite or the mixed structure of martensite and bainite, which is a low-temperature transformation structure, can be decreased, and carbon can be diffused in a short range, thereby improving strength and toughness. If the tempering heat treatment temperature is lower than 550° C., carbon may be insufficiently diffused, resulting in an excessive increase in strength, thereby decreasing toughness. If the tempering heat treatment temperature exceeds 700° C., fresh martensite may be formed due to reverse transformation at a temperature of $Ac_1$ or higher, resulting in extreme deteriorations in toughness and SSC resistance. If the tempering heat treatment time is less than 5 minutes, the time for sufficient diffusion of carbon in the tempering process may be insufficient, thereby reducing toughness due to an excessive increase in strength beyond the appropriate strength range required by the present disclosure. If the tempering heat treatment time exceeds 60 minutes, cementite may be spheroidized due to excessive heating, resulting in a sharp decrease in strength. Therefore, the tempering heat treatment is preferably performed at a temperature of 550 to 700° C. and maintained for 5 to 60 minutes.

MODE FOR INVENTION

Hereinafter, the present disclosure will be described in more detail through examples. It should be noted, however, that the following examples are merely intended to illustratively describe the present disclosure in more detail, not to limit the scope of the present disclosure. This is because the scope of the present disclosure is defined by the matters set forth in the claims and reasonably inferred therefrom.

EXAMPLES

After reheating steel slabs each having an alloy composition shown in Table 1 below at 1100° C., the steel slab was hot-rolled and cooled under conditions shown in Table 2 below, and then heat-treated at 650° C. for 30 minutes through tempering to manufacture a hot-rolled steel having a thickness of 80 mm. After the hot rolling, the hot-rolled steel was cooled to room temperature, and then reheated at 890° C. for 30 minutes. At the time of cooling after the reheating, a primary cooling stop temperature was 700° C., and a secondary cooling stop temperature was 27° C.

With respect to each of the hot-rolled steels manufactured as described above, microstructures, a dislocation density of a surface layer portion, a yield strength, a tensile strength, and a uniform elongation of the surface layer portion were measured. The results are shown in Table 3 below.

The microstructures were measured through observation and analysis using an optical microscope.

The dislocation density of the surface layer portion was measured using X-ray diffraction (XRD).

The yield strength and the tensile strength were measured through tensile tests, and the uniform elongation of the surface layer portion was measured through a tensile test after preparing a specimen by separately processing only the surface layer portion.

SSC resistance testing was performed by measuring a time at which the specimen started to fracture, after the specimen was immersed for 720 hours in 5% NaCl+0.5% $CH_3COOH$ solution saturated with $H_2S$ gas at an atmospheric pressure of 1 atm while applying a load of 90% of the actual yield strength to the specimen according to NACE TM0177.

TABLE 1

| Steel Type | Alloy composition (wt %) | | | | | | | | | | | | | | |
|---|---|---|---|---|---|---|---|---|---|---|---|---|---|---|---|
| No. | C | Si | Mn | Al | P | S | Nb | V | Ti | Cr | Mo | Cu | Ni | Ca | Ceq |
| Inventive Steel 1 | 0.16 | 0.35 | 1.13 | 0.035 | 80 | 8 | 0.007 | 0.006 | 0.001 | 0.50 | 0.13 | 0.05 | 1.8 | 35 | 0.60 |
| Inventive Steel 2 | 0.15 | 0.31 | 1.14 | 0.031 | 70 | 6 | 0.010 | 0.008 | 0.011 | 0.57 | 0.12 | 0.08 | 1.9 | 31 | 0.61 |
| Inventive Steel 3 | 0.18 | 0.33 | 1.35 | 0.030 | 81 | 7 | 0.008 | 0.015 | 0.008 | 0.89 | 0.08 | 0.08 | 2.0 | 27 | 0.74 |
| Inventive Steel 4 | 0.14 | 0.35 | 1.19 | 0.036 | 70 | 8 | 0.013 | 0.013 | 0.012 | 0.91 | 0.10 | 0.15 | 2.1 | 29 | 0.69 |
| Inventive Steel 5 | 0.17 | 0.33 | 1.47 | 0.035 | 65 | 6 | 0.015 | 0.015 | 0.008 | 0.88 | 0.12 | 0.25 | 2.5 | 25 | 0.80 |
| Comparative Steel 1 | 0.35 | 0.36 | 1.15 | 0.030 | 70 | 7 | 0.020 | 0.012 | 0.006 | 0.79 | 0.11 | 0.08 | 2.3 | 25 | 0.88 |
| Comparative Steel 2 | 0.18 | 0.37 | 1.32 | 0.031 | 80 | 8 | 0.020 | 0.011 | 0.007 | 0.001 | 0.14 | 0.15 | 3.4 | 28 | 0.67 |
| Comparative Steel 3 | 0.06 | 0.30 | 1.36 | 0.030 | 80 | 8 | 0.015 | 0.010 | 0.011 | 0.63 | 0.14 | 0.13 | 3.5 | 23 | 0.68 |

The unit for P, S, and Ca is ppm by weight.
Ceq = C + Mn/6 + (Cu + Ni)/15 + (Cr + Mo + V)/5)

TABLE 2

| Classification | Steel Type No. | Finish-rolling temperature (° C.) | Average reduction ratio per pass (%) | Primary cooling rate (° C./s) | Secondary cooling rate (° C./s) |
|---|---|---|---|---|---|
| Inventive Example 1 | Inventive Steel 1 | 851 | 14 | 0.87 | 57 |
| Inventive Example 2 | Inventive Steel 2 | 839 | 12 | 3.45 | 58 |
| Inventive Example 3 | Inventive Steel 3 | 870 | 13 | 2.64 | 63 |
| Inventive Example 4 | Inventive Steel 4 | 888 | 13 | 1.83 | 71 |
| Inventive Example 5 | Inventive Steel 5 | 860 | 13 | 2.35 | 69 |
| Comparative Example 1 | Inventive Steel 1 | 1025 | 17 | 1.91 | 55 |
| Comparative Example 2 | Inventive Steel 2 | 768 | 5 | 1.33 | 63 |
| Comparative Example 3 | Inventive Steel 3 | 891 | 14 | 57 | 70 |
| Comparative Example 4 | Inventive Steel 4 | 890 | 15 | 0.91 | 2 |
| Comparative Example 5 | Inventive Steel 5 | 883 | 14 | 53 | 1 |
| Comparative Example 6 | Comparative Steel 1 | 869 | 16 | 1.3 | 59 |
| Comparative Example 7 | Comparative Steel 2 | 871 | 14 | 0.98 | 58 |
| Comparative Example 8 | Comparative Steel 3 | 891 | 15 | 2.3 | 73 |

TABLE 3

| Classification | Microstructure: AGS (μm) after rolling | Microstructure: Surface layer portion | Microstructure: Center portion | Dislocation density of surface layer portion ($\times 10^{14}/m^2$) | Yield strength (MPa) | Tensile strength (MPa) | Uniform elongation of surface layer portion (%) | Fracture start time(Hr) |
|---|---|---|---|---|---|---|---|---|
| Inventive Example 1 | 22 | 100% F | 100% TM | 2.5 | 732 | 875 | 11 | No fracture |
| Inventive Example 2 | 23 | 100% F | 100% TM | 2.7 | 722 | 877 | 10 | No fracture |
| Inventive Example 3 | 27 | 100% F | 100% TM | 2.3 | 736 | 890 | 12 | No fracture |
| Inventive Example 4 | 25 | 100% F | 100% TM | 2.6 | 757 | 887 | 11 | No fracture |
| Inventive Example 5 | 26 | 100% F | 100% TM | 2.5 | 743 | 869 | 10 | No fracture |
| Comparative Example 1 | 77 | 100% F | 100% TM | 2.5 | 691 | 790 | 11 | 17 |
| Comparative Example 2 | 23 | 100% F | 100% TM | 19 | 891 | 1017 | 12 | 6 |
| Comparative Example 3 | 27 | 100% TM | 100% TM | 50 | 810 | 903 | 13 | 9 |
| Comparative Example 4 | 28 | 100% F | 15% F + 70% P + 15% TB | 27 | 504 | 630 | 5 | No fracture |
| Comparative Example 5 | 24 | 100% TM | 15% F + 30% P + 55% TB | 51 | 763 | 889 | 13 | 16 |
| Comparative Example 6 | 21 | 100% TB | 100% TM | 35 | 845 | 1039 | 4 | 5 |
| Comparative Example 7 | 24 | 100% F | 100% TM | 2.0 | 650 | 708 | 12 | No fracture |
| Comparative Example 8 | 23 | 100% F | 65% F + 35% TB | 2.1 | 550 | 627 | 13 | No fracture |

TM: tempered martensite,
TB: tempered bainite,
F: polygonal ferrite,
P: perlite

As can be seen from Tables 1 to 3 above, in Inventive Examples 1 to 5 satisfying the alloy composition and the manufacturing conditions proposed by the present disclosure, when the following conditions are satisfied: polygonal ferrite is formed in the surface layer portion; tempered martensite is formed in the center portion; and the surface layer portion has a dislocation density of $3\times10^{14}/m^2$ or less, excellent strength, excellent uniform elongation of the surface layer portion, and excellent SSC resistance can be secured.

However, in Comparative Examples 1 to 5 in which the manufacturing conditions proposed by the present disclosure are not satisfied although the alloy composition proposed by the present disclosure is satisfied, it can be seen that when the conditions proposed by the present disclosure concerning the types of microstructures and the fractions thereof or the dislocation density of the surface layer portion are not satisfied, strength, uniform elongation of the surface layer portion, or SSC resistance is low.

In Comparative Examples 6 to 8 in which the alloy composition proposed by the present disclosure is not satisfied although the manufacturing conditions proposed by the present disclosure are satisfied, it can be seen that when the conditions proposed by the present disclosure concerning the types of microstructures and the fractions thereof or the dislocation density of the surface layer portion are not satisfied, strength, uniform elongation of the surface layer portion, or SSC resistance is low.

The invention claimed is:

1. A steel comprising, by wt %, more than 0.08% and 0.2% or less of carbon (C), 0.05 to 0.5% of silicon (Si), 0.5 to 2% of manganese (Mn), 0.005 to 0.1% of aluminum (Al), 0.01% or less of phosphorus (P), 0.0015% or less of sulfur (S), 0.001 to 0.03% of niobium (Nb), 0.001 to 0.03% of vanadium (V), 0.001 to 0.03% of titanium (Ti), 0.01 to 1% of chromium (Cr), 0.01 to 0.15% of molybdenum (Mo), 0.01 to 0.5% of copper (Cu), 0.05 to 4% of nickel (Ni), and 0.0005 to 0.004% of calcium (Ca), with a balance of Fe and other inevitable impurities, wherein a microstructure of a surface layer portion, which is a region from a surface of the steel to 10% of a total thickness of the steel, comprises 90 area % or more of polygonal ferrite, a microstructure of a region excluding the surface layer portion comprises 90 area % or more of tempered martensite or 90 area % or more of a mixed structure of tempered martensite and tempered bainite, and the surface layer portion has a dislocation density of $3\times10^{14}/m^2$ or less.

2. The steel of claim 1, wherein the steel has a Ceq of 0.5 or more, the Ceq being expressed by the following Relational Expression 1:

$$Ceq=C+Mn/6+(Cu+Ni)/15+(Cr+Mo+V)/5)$$

where C, Mn, Cu, Ni, Cr, Mo, and V are based on wt %.

3. The steel of claim 1, wherein the steel has a thickness of 6 to 100 mm.

4. The steel of claim 1, wherein the surface layer portion of the steel has a uniform elongation of 10% or more.

5. The steel of claim 1, wherein the steel has a yield strength of 690 MPa or more and a tensile strength of 780 MPa or more.

* * * * *